US009680207B2

(12) United States Patent
Lin et al.

(10) Patent No.: US 9,680,207 B2
(45) Date of Patent: Jun. 13, 2017

(54) ANTENNA MODULE

(71) Applicant: Smart Approach CO., LTD., Hsinchu (TW)

(72) Inventors: Hsin-Lung Lin, Hsinchu (TW); Chia-Liang Hung, Changhua County (TW); Jhih-Yao You, Hsinchu (TW)

(73) Assignee: SMART APPROACH CO., LTD., Hsinchu (TW)

( * ) Notice: Subject to any disclaimer, the term of this patent is extended or adjusted under 35 U.S.C. 154(b) by 78 days.

(21) Appl. No.: 14/704,664

(22) Filed: May 5, 2015

(65) Prior Publication Data

US 2016/0218415 A1 Jul. 28, 2016

(30) Foreign Application Priority Data

Jan. 23, 2015 (TW) ..... 104102397 A

(51) Int. Cl.
*H01Q 1/24* (2006.01)

(52) U.S. Cl.
CPC ..... *H01Q 1/243* (2013.01)

(58) Field of Classification Search
CPC ..... H01Q 1/243
USPC ..... 343/702, 722, 850
See application file for complete search history.

(56) References Cited

U.S. PATENT DOCUMENTS 4,421,265 A * 12/1983 Boyer ..... B23K 3/08 228/180.1
6,005,773 A * 12/1999 Rozman ..... H02M 3/00 361/707
6,747,875 B2 * 6/2004 Wildrick ..... H05K 3/3426 361/736
6,867,982 B2 * 3/2005 Ito ..... H05K 9/0022 174/363
7,561,203 B2 * 7/2009 Pistemaa ..... H04M 1/0214 348/240.99
7,659,855 B2 * 2/2010 Mashima ..... H01Q 1/243 343/702
8,174,453 B2 * 5/2012 Wong ..... H01Q 1/243 343/702

* cited by examiner

*Primary Examiner* — Tho G Phan
(74) *Attorney, Agent, or Firm* — Maschoff Brennan

(57) ABSTRACT

An antenna module applied to an electronic device including a wireless communication controller and a body that includes an opening. The antenna module includes a first inductance component and a metal case. The first inductance component includes a first end and a second end, and the first end of the first inductance component is electrically connected to an end of the wireless communication controller. The metal case includes a first connection point and a second connection point. The first connection point is electrically connected to the second end of the first inductance component, and the second connection point is a preset distance away from the first connection point and electrically connected to the wireless communication controller.

10 Claims, 5 Drawing Sheets

ANTENNA MODULE

CROSS-REFERENCE TO RELATED APPLICATIONS

This non-provisional application claims priority under 35 U.S.C. §119(a) on Patent Application No(s). 104102397 filed in Taiwan, R.O.C. on Jan. 23, 2015, the entire contents of which are hereby incorporated by reference.

TECHNICAL FIELD

The disclosure relates to an antenna module, more particularly to an antenna module whose metal case allows a magnetic field to be produced for wireless communication or wireless charging.

BACKGROUND

Near field communication (NFC) is a wireless communication technology based on a high frequency and a short transmission length. This technology enables a single chip to combine the function of a proximity card reader, the function of a proximity card and the function of the peer-to-peer (P2P) technology together to make an electronic device having the chip perform identification and/or data exchange to another electronic device that is a short distance away from the electronic device having the chip. The electronic device having the chip is capable of fast inducting and has a simple structure so that it can widely be applied to applications of micro-payment, such as ticket purchases and digital wallets.

On the other hand, with the enhancement of wireless communication technology, international alliances, such as Alliance for Wireless Power (A4WP), also strive for promoting specifications of wireless charging. This causes the wireless charging market to be formed.

In order to incorporate more functions in the electronic device or minimize the electronic device, components of the electronic device have to be arranged and carried out by a different way to match its development trend in the art.

SUMMARY

The disclosure provides an antenna module which uses a metal case and one or more inductance components to replace antennas of wireless communication or wireless charging disposed in an electronic device, so as to save space for components related to the wireless communication or charging and minimize the electronic device.

According to one or more embodiments, the disclosure provides an antenna module applied to an electronic device that includes a wireless communication controller and a body that includes an opening. In one embodiment, the antenna module includes a first inductance component and a metal case. The first inductance component includes a first end and a second end. The first end of the first inductance component is electrically connected to one end of the wireless communication controller. The metal case includes a first connection point and a second connection point that is a preset distance away from the first connection point. The first connection point is electrically connected to the second end of the first inductance component, and the second connection point is electrically connected to the wireless communication controller.

In another embodiment, the antenna module includes a first inductance component, a second inductance component, and a metal case. The first inductance component includes a first end and a second end, and the first end of the first inductance component is electrically connected to an end of the wireless communication controller. The second inductance component includes a first end and a second end, and the first end of the second inductance component is electrically connected to another end of the wireless communication controller. The metal case includes a first connection point electrically connected to the second end of the first inductance component, and a second connection point electrically connected to the second end of the second inductance component.

Accordingly, the disclosure combines the metal case and the one or more inductance components to form the antenna module with a desired inductance value. When a current is inputted to the antenna module, a magnetic field corresponding to the current is formed and wireless signals with a certain frequency are sent out. In this way, the electronic device including the antenna module is capable of performing wireless communication or wireless charging to other electronic devices. Such an electronic device is capable of providing a stronger magnetic field to enhance the quality of communication and the quality of charging without adding space for extra components, the electronic device can widely be applied to portable electronic devices.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION

Figure 1A:
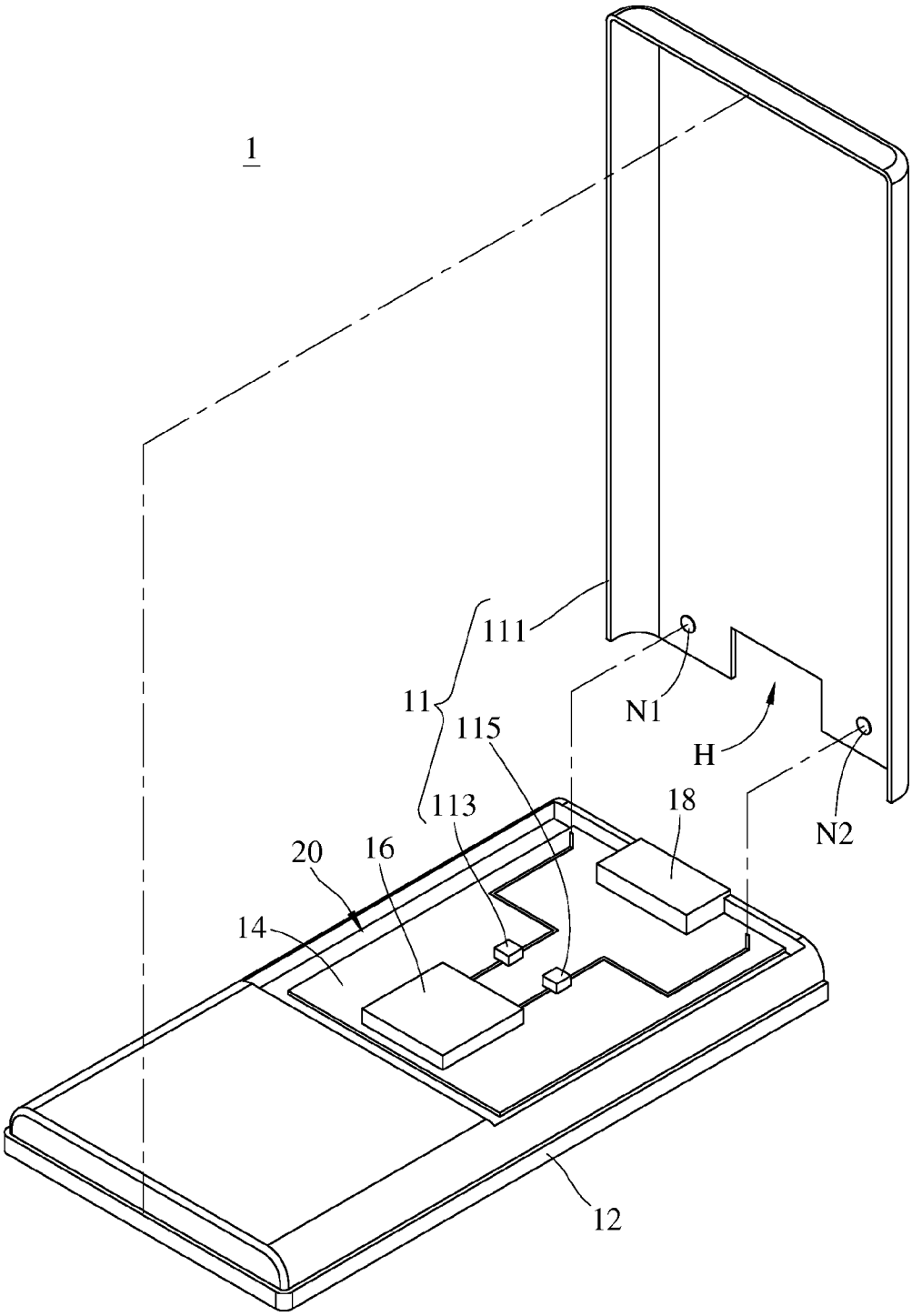
FIG. 1A is a schematic three-dimensional view showing an antenna module and an electronic device according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

The disclosure provides an antenna module which cooperates with an electronic device including an opening. Please refer to FIG. 1A, which is a schematic three-dimensional view showing an antenna module 11 and an electronic device according to an embodiment of the disclosure. The antenna module 11 includes, for example but not limited to, a metal case 111 and inductance components 113 (referred to as the first inductance component) and 115 (referred to as the second inductance component). The metal case 111 has two connection points N1 and N2 and an opening H which extends from a certain edge of the metal case 111. The connection points N1 and N2 are near such a certain edge of the metal case 111, and the opening H is between the connection point N1 and the connection point N2. The metal case 111 is made of, for example but not limited to, electric-conductive material. The electric-conductive material is, for example but not limited to, aluminum (Al) or magnesium (Mg) alloy. For example, the inductance components 113 and 115 are, but not limited to, multilayer chip ceramic inductors or cables. For example, the shape of the opening H is, but not limited to, rectangular, circular, elliptical, keyhole-shaped or irregular serpentine-shaped.

The electronic device 1 includes a body 12 that at least includes a baseboard 14, a wireless communication controller 16, and an opening 20 for exposing relative components. For instance, the electronic device 1 is, but not limited to, a mobile electronic device such as a mobile phone or a tablet computer, or a wearable device such as a smart watch. In the drawing, the components disposed on the body 12 are shown for an example to clearly describe the disclosure. In this or some embodiments, the body 12 is capable of being disposed with more components such that the electronic device 1 will have more relative functions.

The baseboard 14 is in the body 12, and the wireless communication controller 16 and the inductance components 113 and 115 are on the baseboard 14. The metal case 111 is removable, is assembled with the body 12, and covers the opening 20 so as to protect the components in the body 12. The metal case 111 is assembled with the body 12 by, for example but not limited to, a fastening structure. The first ends of the inductance components 113 and 115 are electrically connected to two ends of the wireless communication controller 16 respectively, and the second ends of the inductance components 113 and 115 are exposed from the opening 20. Therefore, when the metal case 111 and the body 12 are assembled together, the second ends of the inductance components 113 and 115 respectively press against the connection points N1 and N2 of the metal case 111 and are electrically connected to the metal case 111, so as to form a current path.

The wireless communication controller 16 outputs a current to the current path such that the antenna module 11 produces a magnetic field corresponding to the current. The electronic device 1 receives or sends wireless signals through the magnetic field to perform wireless communication. When the frequency of the wireless signal is, for example but not limited to, 13.56 mega Hertz (MHz), the electronic device 1 may perform the near field communication (NFC) using these signals. When the frequency of the wireless signal is, for example but not limited to, 6.78 MHz, the electronic device 1 may perform the wireless charging with the magnetic resonance based on the standard of Wireless Power Consortium.

As an equivalent circuit, a part of the metal case 111 and the inductance components 113 and 115 are connected in series, and the metal case 111 and the inductance components 113 and 115 further cooperate with the inner circuit of the wireless communication controller 16 to form a complete resonant circuit for generating wireless signals at a certain frequency. The inductance values of the inductance components 113 and 115 affect the quality factor (also known as Q value) of the resonant circuit and even the communication quality of the antenna module 11 during the wireless communication or wireless charging. The inductance values of the inductance components 113 and 115 and the relative Q value are associated with multiple considerations for a system design, and the disclosure will have no limitation on these values.

Figure 1B:
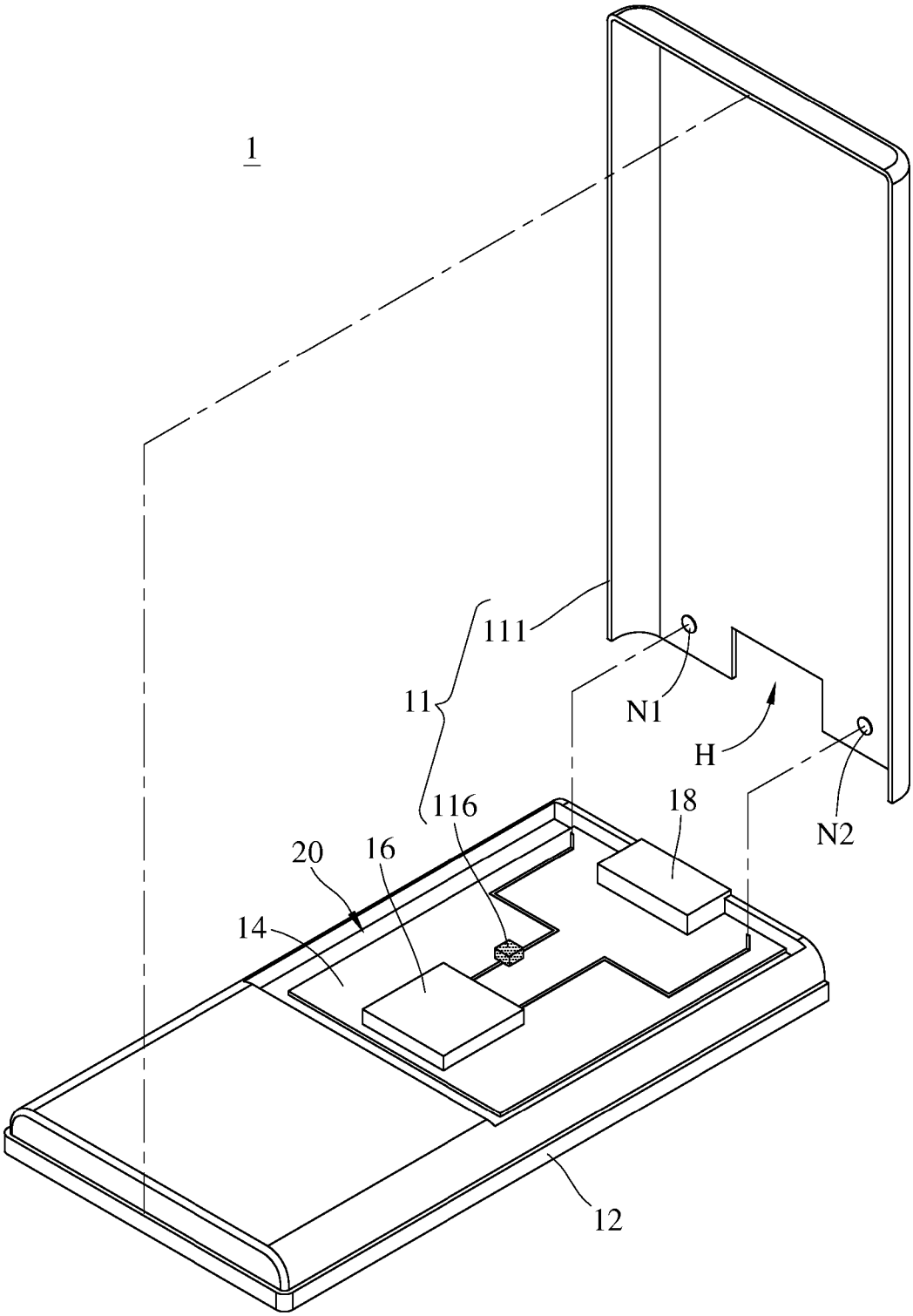
FIG. 1B is a schematic three-dimensional view showing an antenna module and an electronic device according to another embodiment of the disclosure.

In an embodiment, the inductance components 113 and 115 are combined together to form a single equivalent inductance component. This equivalent inductance component has an inductance value equal to the sum of the inductance values of the inductance components 113 and 115, as shown in FIG. 1B which is a schematic three-dimensional view showing an antenna module 11 and an electronic device 1 according to another embodiment of the disclosure. The antenna module 11 includes an equivalent inductance component 116. One end of the equivalent inductance component 116 is electrically connected to the wireless communication controller 16, and the other end of the equivalent inductance component 116 is electrically connected to the connection point N1 of the metal case 111. The connection point N2 of the metal case 111 is directly and electrically connected to the wireless communication controller 16. Herein, the equivalent inductance component 116, the wireless communication controller 16, and a part of the metal case 111 are connected in series to form an equivalent resonant circuit that is capable of letting the electronic device 1 perform the wireless communication and the wireless charging.

The opening H of the metal case 111 not only makes the current path formed but also exposes relative components of the electronic device 1 for relative application. As shown in FIG. 1A, the electronic device 1 further includes an application module 18 disposed on the baseboard 14. The shape of the application module 18 is, for example but not limited to, based on the shape of the opening H so is exposed from the opening H of the body 12. The application module 18 is, for example but not limited to, a video camera or a lens of a camera and is exposed from the opening H to capture images.

Accordingly, the opening 20 exposes the second ends of the inductance components 113 and 115. When the metal case 111 and the body 12 are assembled together, the inductance components 113 and 115 are electrically connected to the connection points N1 and N2 of the metal case 111, respectively. In an embodiment, the opening 20 exposes the entire baseboard 14, as shown in FIG. 1A. In another embodiment, the opening 20 partially exposes the baseboard 14. For example, the opening 20 exposes only the second ends of the inductance components 113 and 115. In other words, the electronic device 1 uses the metal case 111 to protect the components of the body 12 and is further disposed with a guard board to cover the opening 20 and protect the body 12 and the components except the second ends of the inductance components 113 and 115. The body 12 and the metal case 111 can be designed according to actual application requirements.

Figure 1C:
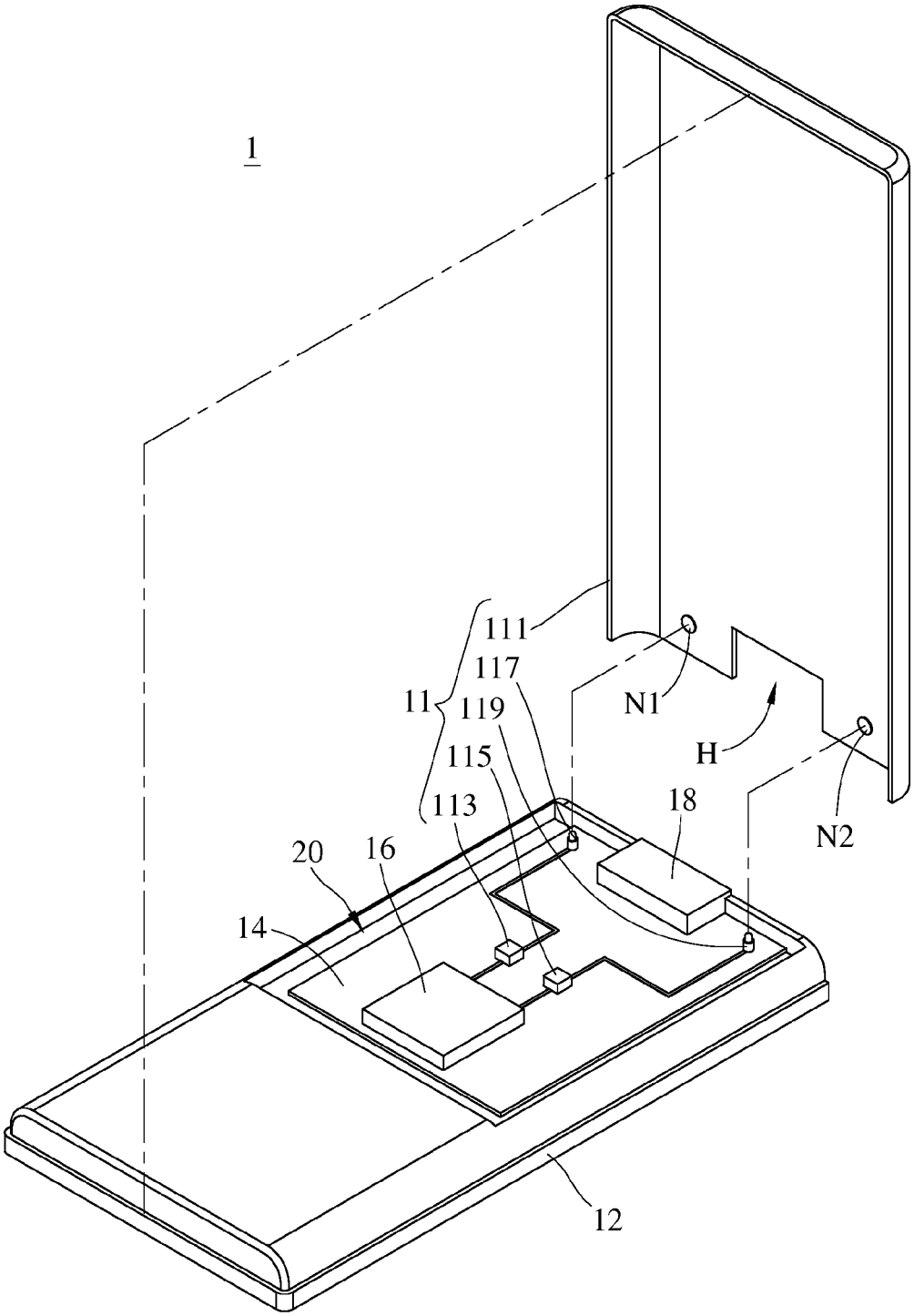
FIG. 1C is a schematic three-dimensional view showing an antenna module and an electronic device according to another embodiment of the disclosure.

In another embodiment, the antenna module 11 further includes two extra pins to increase the quality of transmitting a current to the metal case 111, as shown in FIG. 1C, which is a schematic three-dimensional view showing an antenna module 11 and an electronic device 1 according to another embodiment of the disclosure. The antenna module 11 further includes pins 117 (referred to as a first pin) and 119 (referred to as a second pin). The pins 117 and 119 are disposed on the baseboard 14. One end of the pin 117 is electrically connected to the other end of the inductance component 113, one end of the pin 119 is electrically connected to the other end of the inductance component 115, and the other ends of the pins 117 and 119 are exposed from the opening 20. When the metal case 111 is assembled to the body 12, the end of the pin 117 exposed from the opening 20 presses against the connection point N1 and the other end of the pin 119 presses against the connection point N2. Therefore, the pins 117 and 119 are electrically connected to the metal case 111 to form the above current path. For example, the pins 117 and 119 are, but not limited to, POGO pins.

In an embodiment, the inductance components 113 and 115 are combined to form a single equivalent inductance component 116. One end of this equivalent inductance component 116 is electrically connected to one end of the pin 117, and the other end of the inductance component 116 is electrically connected to the wireless communication controller 16. The connection point N1 of the metal case 111 is electrically connected to the other end of the pin 117. One end of the pin 119 is electrically connected to the wireless communication controller 16, and the other end of the pin 119 is electrically connected to the connection point N2 of the metal case 111. Accordingly, the foregoing components are connected in series to form an equivalent resonant circuit as shown in FIG. 1C.

In FIG. 1C, the metal case 111 includes an opening H between the connection points N1 and N2. After the metal case 111 is assembled with the body 12, a current path on the metal case 111 mainly includes the connection points N1 and N2 and the periphery of the metal case 111 that is close to the opening H.

Figure 2A:
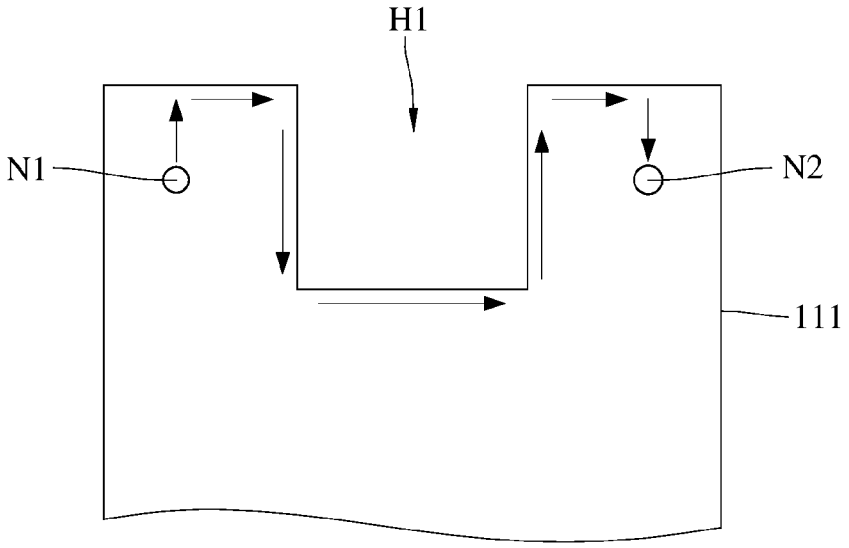
FIG. 2A is a schematic diagram showing a rectangular opening and a relative current path according to an embodiment of the disclosure.

Please refer to FIG. 2A, which is a schematic diagram showing a rectangular opening and a relative current path according to an embodiment of the disclosure. The opening H1 is rectangular, and there is a current path along the edge of the rectangular opening H1. Specifically, when the wireless communication controller 16 outputs a current to the current path, the current on the metal case 111 will flow from the connection point N1 of the metal case 111 to the connection point N2 of the metal case 111 along the periphery of the metal case 111 close to the opening H1. When flowing along the periphery of the metal case 111 close to the opening H1, the traveling direction of the current will change with the shape of the opening H1.

Since the current path is mainly on the periphery of the metal case 111 close to the opening H1, the magnetic field produced based on the current flowing along the current path is mainly on the periphery of the metal case 111 close to the opening H1. Moreover, in order to clearly describe the current path, the above description is based on the current flowing from the connection point N1 to the connection point N2, as shown in FIG. 2A. In another embodiment, the current may be alternating current (AC) electricity such that the current may be a two-way current and have a varied current value. For example, the current alternately flows from the connection point N1 to the connection point N2 and from the connection point N2 to the connection point N1.

Figure 2B:
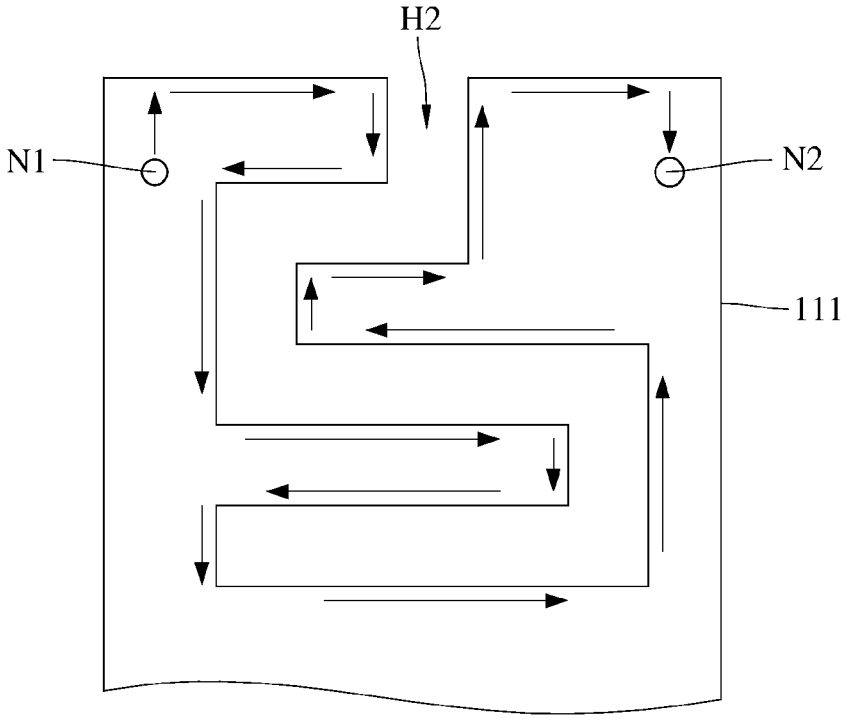
FIG. 2B is a schematic diagram showing an irregular serpentine-shaped opening and a relative current path according to an embodiment of the disclosure.

On the other hand, since the current path on the metal case 111 corresponds to and is varied according to the shape of the opening H, the intensity of the magnetic field is varied according to the current. Please refer to FIG. 2B, which is FIG. 2B is a schematic diagram showing an irregular serpentine-shaped opening and a relative current path according to an embodiment of the disclosure. In FIG. 2B, an opening H2 is irregular serpentine-shaped. When the wireless communication controller 16 inputs a current to the metal case 111, the current flows from the connection point N1 to the connection point N2 along the serpentine periphery of the metal case 111 close to the opening H2 in the marked direction shown in FIG. 2B. A magnetic field is mainly formed on the periphery of the metal case 111 close to the opening H2.

In view of the electromagnetism, under the same intensity of input current, when the number of curves appearing on the current path on the metal case 111 increases, the magnetic flux per unit area becomes higher and the intensity of the magnetic field becomes stronger as well. Because the opening H2 shown in FIG. 2B is irregular serpentine-shaped and has more curves at its edge than the number of curves at the edge of the rectangular opening H1 shown in FIG. 2A, the magnetic field produced based on the current flowing along the current path in FIG. 2B is stronger than the magnetic field produced based on the current flowing along the current path in FIG. 2A. When the antenna module 11 is applied to the near field communication, the minimum height or shortest distance for induction is affected by the current path. In other words, the design of the opening H will effect such a minimum induction distance and range.

Figure 2C:
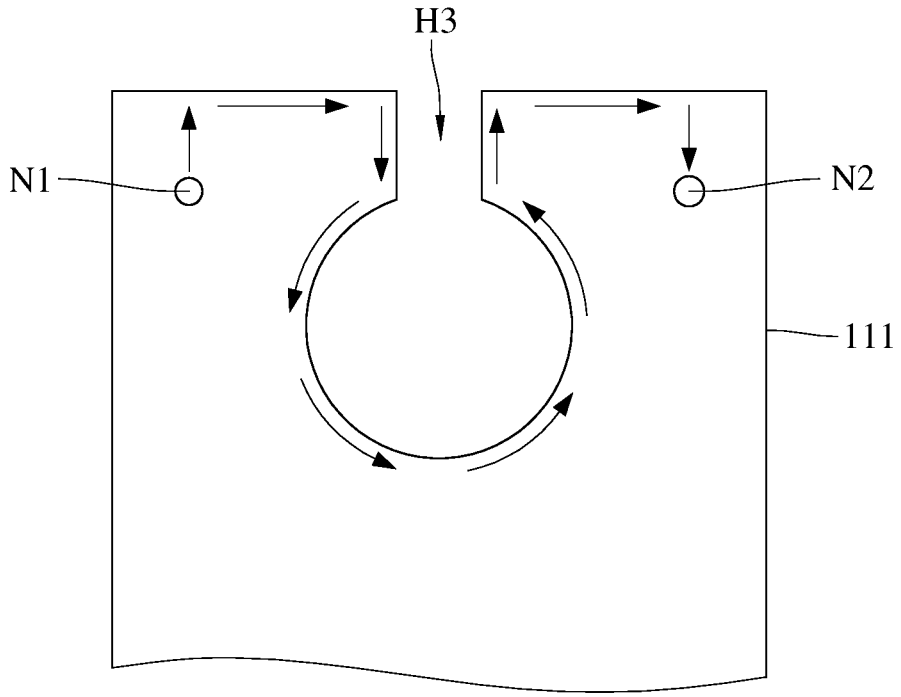
FIG. 2C is a schematic diagram showing a keyhole-shaped opening and a relative current path according to an embodiment of the disclosure.

In an embodiment, the opening H is designed according to the desired intensity of the magnetic field as well as the shape of the application module 18. Please refer to FIG. 2C, which is a schematic diagram showing a keyhole-shaped opening and a relative current path according to an embodiment of the disclosure. An opening H3 includes a circular section and a rectangular section. The circular section matches the shape of the application module 18. The metal case 111 exposes the application module 18 but covers and protects other components to be hidden. The rectangular section of the opening H3 extends the current path such that the magnetic field may achieve a desired intensity. For example, the application module 18 is, but not limited to, a circular lens of a camera or a video camera.

The shape of the opening H3 is designed to match the appearance of the electronic device 1. For example, the shape of the opening H3 is like, but not limited to, a trade mark or logo of a manufacturer.

In an embodiment, the above opening H is a selective design to the metal case 111. If the shape of the metal case 111 matches the relative locations of the connection points N1 and N2 to let a desired current path be formed, the metal case 111 without the above opening H can be formed.

In view of the above embodiments, the disclosure provides the antenna module which has a desired inductance value obtained when the metal case cooperates with the one or more inductance components, so as to achieve the functions of a conventional antenna that is formed by coils. When a current is inputted to the antenna module, a magnetic field corresponding to the current is formed and wireless signals with a certain frequency are sent out. In this way, the electronic device including the antenna module is capable of performing wireless communication or wireless charging to other electronic devices. Since the antenna module is capable of saving space for extra components to perform wireless communication and/or wireless charging, the electronic device including the antenna module is simplified and the antenna module is capable of widely being applied to portable electronic devices and may be very utility.

What is claimed is:

1. An antenna module applied to an electronic device comprising a wireless communication controller and a body that comprises an opening, and the antenna module comprising:

a first inductance component comprising a first end and a second end, and the first end of the first inductance component being electrically connected to an end of the wireless communication controller;

a metal case comprising a first connection point electrically connected to the second end of the first inductance component, and a second connection point being a preset distance away from the first connection point and electrically connected to the wireless communication controller; and a second inductance component comprising a first end and a second end, the first end of the second inductance component being electrically connected to another end of the wireless communication controller, and the second end of the second inductance component being electrically connected to the second connection point of the metal case;

wherein the opening of the metal case has a shape that indicates a trade mark or a logo or is rectangular, circular, elliptical, keyhole-shaped or irregular serpentine-shaped and an application module is exposed to the opening of the metal case.

2. The antenna module according to claim 1, wherein when the wireless communication controller outputs a current to the metal case, the current flows along a periphery of the metal case.

3. The antenna module according to claim 1, wherein the metal case comprises an opening that is between the first connection point and the second connection point of the metal case.

4. The antenna module according to claim 1, further comprising:

a first pin electrically connected to and the second end of the first inductance component and the first connection point of the metal case; and a second pin electrically connected to the wireless communication controller and the second connection point of the metal case.

5. The antenna module according to claim 1, wherein when the wireless communication controller in the electronic device outputs a current to the antenna module, the antenna module produces a magnetic field.

6. The antenna module according to claim 5, wherein the current outputted by the wireless communication controller flows along a periphery of the metal case from one of the first and second connection points of the metal case to the other one of the first and second connection points of the metal case.

7. The antenna module according to claim 1, wherein the metal case is removable, disposed on the electronic device, and covers the opening.

8. An antenna module applied to an electronic device comprising a wireless communication controller and a body that comprises an opening, and the antenna module comprising:

a first inductance component comprising a first end and a second end, and the first end of the first inductance component being electrically connected to an end of the wireless communication controller;

a second inductance component comprising a first end and a second end, the first end of the second inductance component being electrically connected to another end of the wireless communication controller; and a metal case comprising a first connection point electrically connected to the second end of the first inductance component, and a second connection point electrically connected to the second end of the second inductance component;

wherein an application module is exposed to the opening of the metal case.

9. The antenna module according to claim 8, further comprising:

a first pin electrically connected to the second end of the first inductance component and the first connection point of the metal case; and a second pin electrically connected to the second end of the second inductance component and the second connection point of the metal case.

10. The antenna module according to claim 8, wherein when the wireless communication controller outputs a current to the metal case, the current flows along a periphery of the metal case.

* * * * *